US008887321B1

(12) United States Patent
Maurer

(10) Patent No.: US 8,887,321 B1
(45) Date of Patent: Nov. 18, 2014

(54) SWIVELING SEAT ASSEMBLY

(76) Inventor: K. Richard Maurer, Indianapolis, IN (US)

( * ) Notice: Subject to any disclaimer, the term of this patent is extended or adjusted under 35 U.S.C. 154(b) by 394 days.

(21) Appl. No.: 13/348,942

(22) Filed: Jan. 12, 2012

(51) Int. Cl.
*A47K 3/022* (2006.01)
*A47K 3/12* (2006.01)

(52) U.S. Cl.
CPC ..... *A47K 3/122* (2013.01)
USPC ..... 4/578.1

(58) Field of Classification Search
CPC ..... A47K 3/122
USPC ..... 4/578.1, 579
See application file for complete search history.

(56) References Cited

U.S. PATENT DOCUMENTS

| | | | | |
|---|---|---|---|---|
| 2,765,475 | A | | 10/1956 | Nolan |
| 3,289,217 | A | | 12/1966 | Glover |
| 4,253,203 | A | | 3/1981 | Thomas |
| 4,412,844 | A | | 11/1983 | Collins et al. |
| 4,941,218 | A | | 7/1990 | McCartney |
| 5,373,591 | A | | 12/1994 | Myers |
| D360,025 | S | | 7/1995 | Smith |
| 5,983,418 | A | * | 11/1999 | Goodman et al. ..... 4/571.1 |
| 6,035,459 | A | | 3/2000 | Sadek |
| 6,088,847 | A | * | 7/2000 | Burrow ..... 4/579 |
| 6,834,400 | B2 | | 12/2004 | Zanardelli et al. |
| 6,854,803 | B2 | * | 2/2005 | Tomas et al. ..... 297/423.41 |
| 7,310,837 | B2 | * | 12/2007 | Reynolds et al. ..... 4/579 |
| 2011/0308005 | A1 | * | 12/2011 | Smith ..... 4/579 |

* cited by examiner

*Primary Examiner* — Huyen Le
*Assistant Examiner* — Janie Christiansen

(57) ABSTRACT

The present invention teaches a swiveling seat assembly for use on an outer wall of a bathtub. The seat assembly has a frame, a swiveling base that is connected to the top of the frame, and a seat that is connected to the swiveling base. The swiveling seat assembly can be placed on an outer wall of a standard size bathtub. A lower footing of an outer side member of the frame contacts a ground surface, and a top member inner surface of the frame contacts an outer wall top surface of the standard size bathtub, and an inner side member inner surface contacts an outer wall inner surface of the standard size bathtub. A user can sit upon the seat assembly, and swivel 360 degrees.

1 Claim, 4 Drawing Sheets

SWIVELING SEAT ASSEMBLY

BACKGROUND OF THE INVENTION

Bathtubs have been used as a fixture in a household bathroom for many years. Although bathtubs are primarily used for personal bathing, other tasks are performed in or in the vicinity of a bathtub that requires a person sitting on a side wall of a bathtub. Some examples may be bathing a baby, an elder, or a pet, or cleaning activities that involve using the bathtub as a wash basin. Further activities may involve personal grooming such as shaving the legs, or taking a sponge bath. A need exists for a safe, versatile and comfortable seat on the side wall of the bathtub for use in these tasks.

SUMMARY

The present invention features a swiveling seat assembly for use on an outer wall of a bathtub. In some embodiments, the seat assembly has a frame, a swiveling base that is connected to the top of the frame, and a seat that is connected to the swiveling base.

In some embodiments, the swiveling seat assembly can be placed on an outer wall of a standard size bathtub. In some embodiments, a lower footing of the outer side member of the frame contacts a ground surface, and a top member inner surface of the frame contacts an outer wall top surface of the standard size bathtub, and an inner side member inner surface contacts an outer wall inner surface of the standard size bathtub. In some embodiments, a user can sit upon the seat assembly, and swivel 360 degrees.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
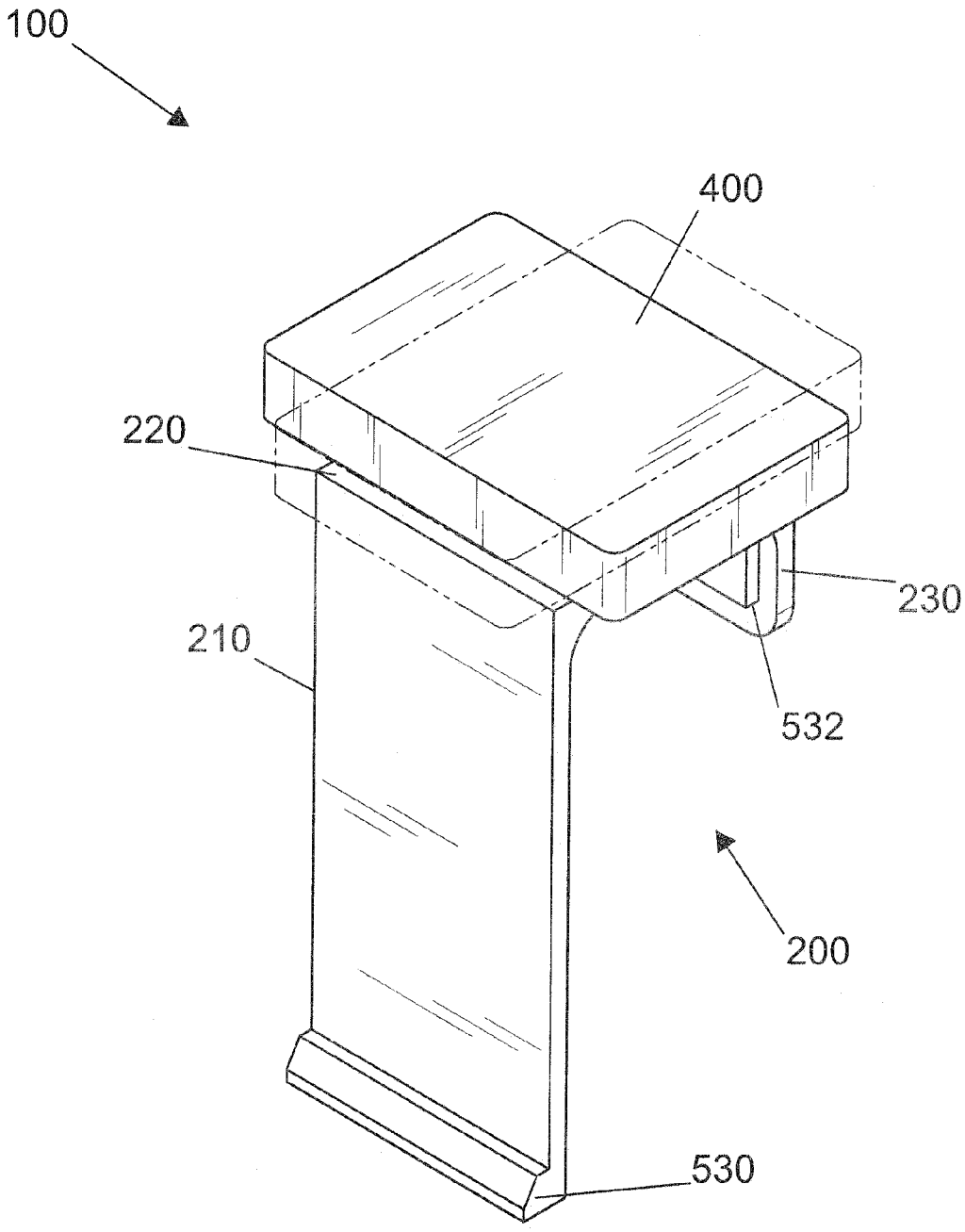
FIG. 1 is a perspective view of the present invention.

Following is a list of elements corresponding to a particular element referred to herein:

100 Swiveling seat assembly
200 Frame
210 Outer side member
212 Outer side member inner surface
220 Top member
222 Top member inner surface
224 Top member outer surface
230 Inner side member
232 Inner side member inner surface
300 Swiveling base
310 Lower Base
320 Upper Base
330 Rotational Member

Figure 2:
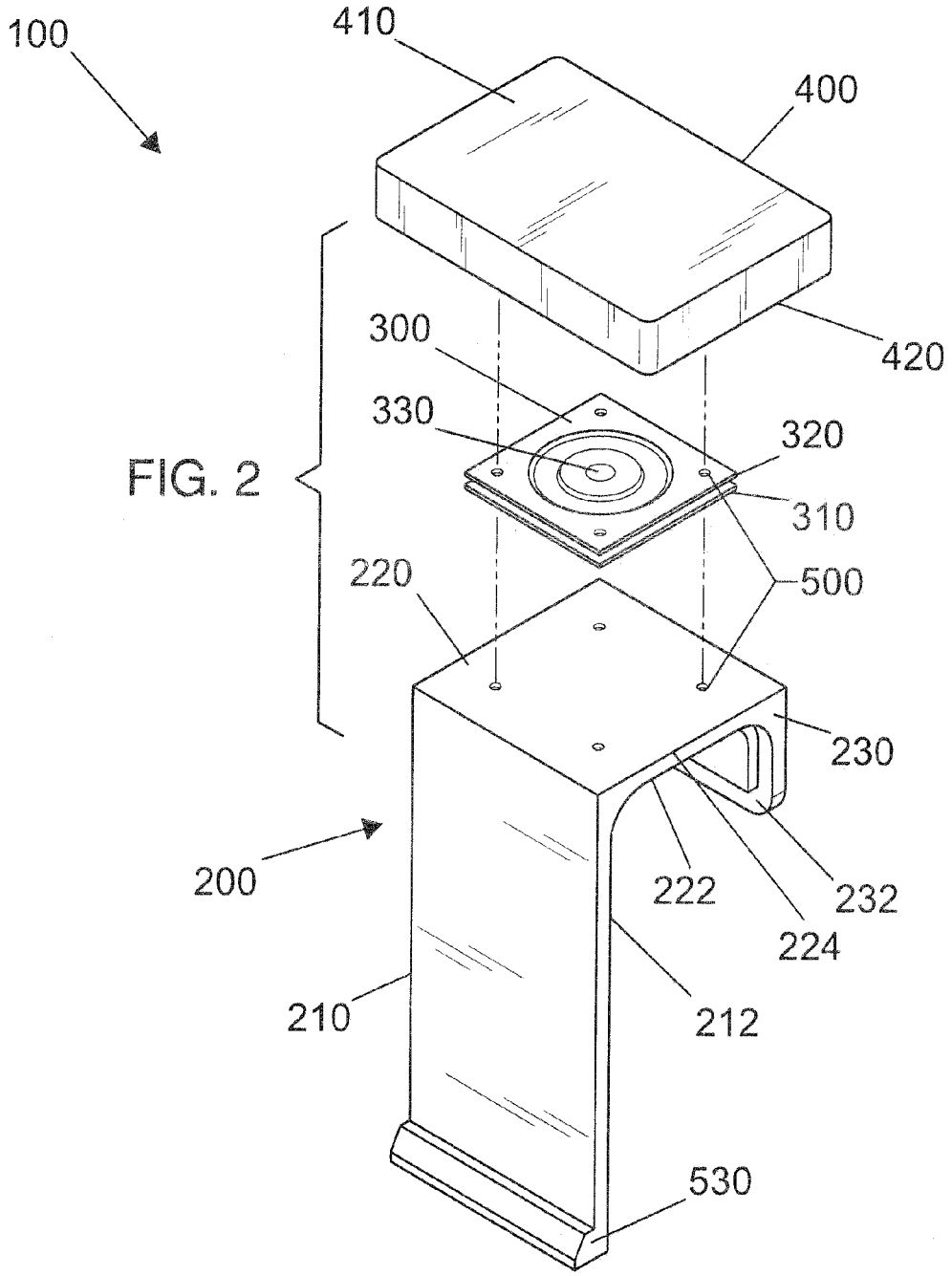
FIG. 2 is an exploded view of the present invention.
Figure 3:
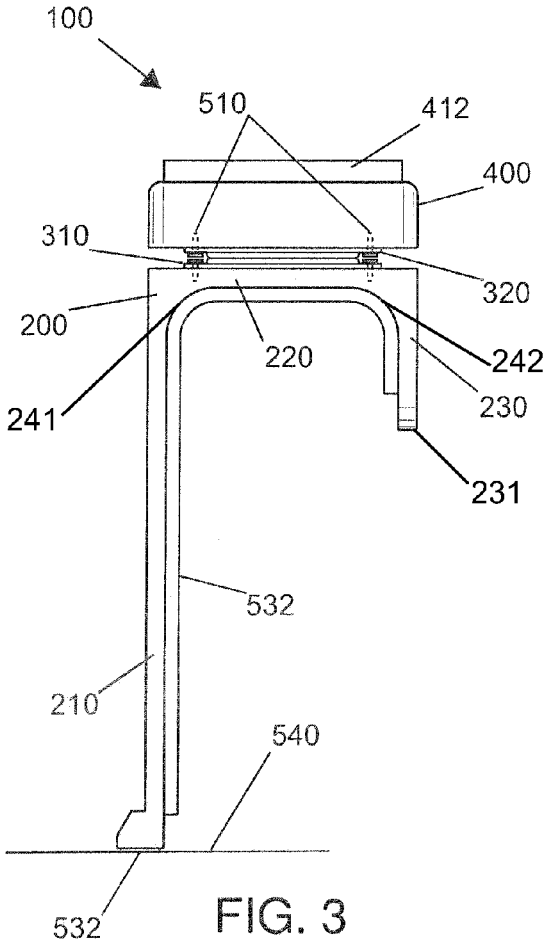
FIG. 3 is a side view of the present invention.
Figure 4:
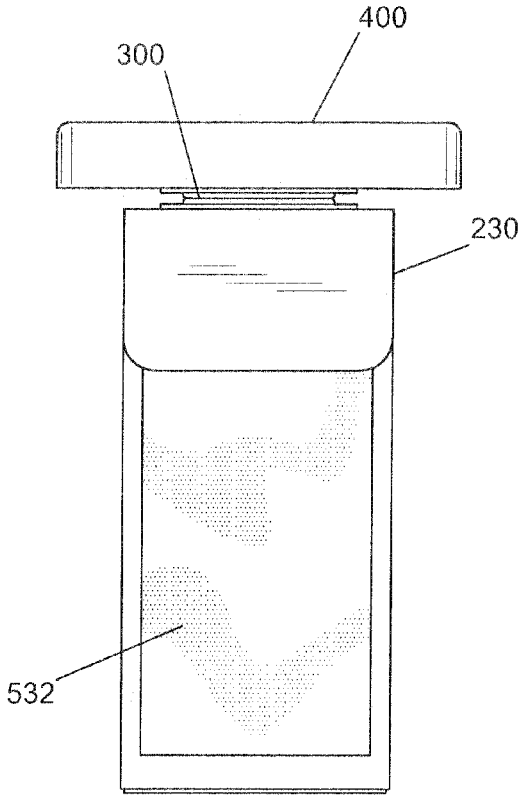
FIG. 4 is a rear view of the present invention.
Figure 5:
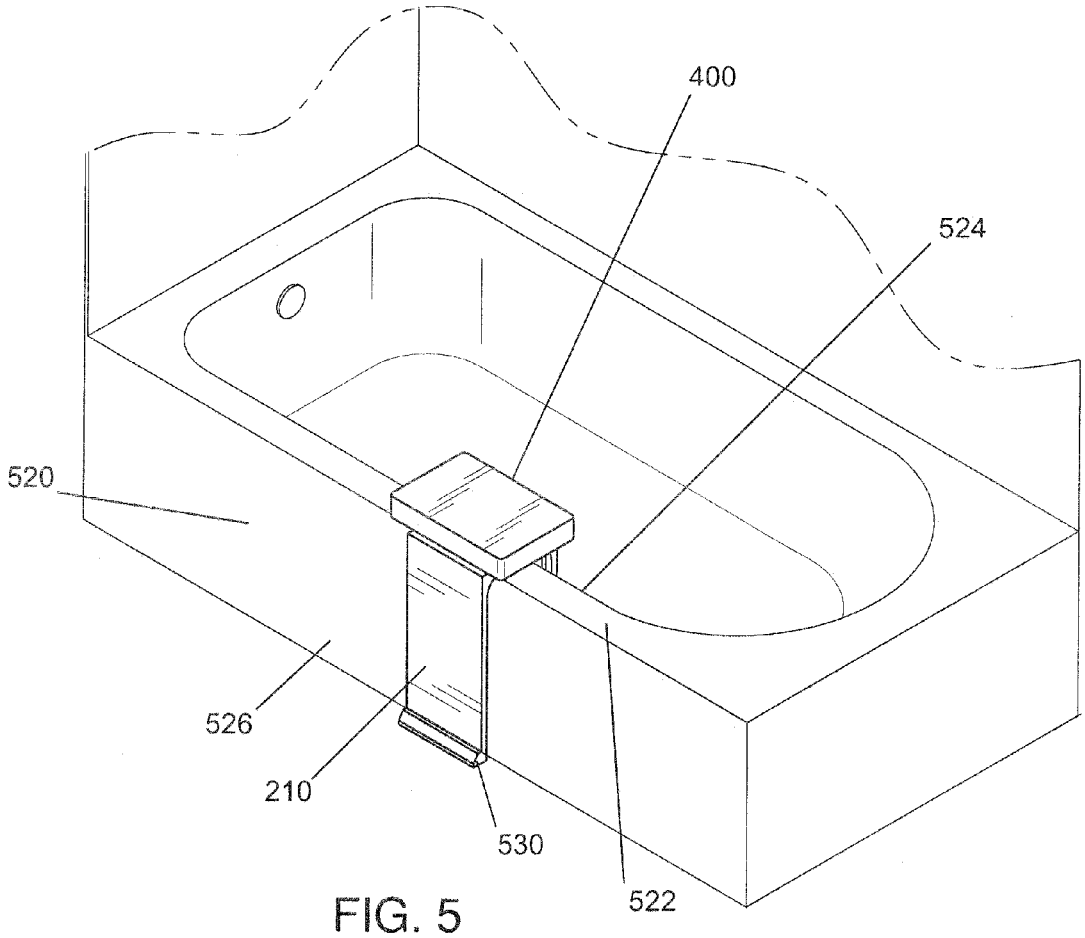
FIG. 5 is a perspective view of the present invention placed in a useful position.

400 Seat
410 Top sitting surface
412 Cushion
420 Bottom mounting surface
500 Mounting hole
510 Fastener
520 Outer wall
522 Outer wall top surface
524 Outer wall inner surface
526 Outer wall outer surface
530 Lower footing
532 Non-slip pad
540 Ground surface Referring now to FIG. 1-5 the present invention features a swiveling seat assembly (100) for safe, and comfortable use on an outer wall (520) of a bathtub.

In some embodiments, the seat assembly (100) has a frame (200) with an outer side member (210), a lower footing (530), an outer side member inner surface (212), a top member (220), a top member inner surface (222), a top member outer surface (224), an inner side member (230), and an inner side member inner surface (232). In some embodiments, the frame (200) has a plurality of mounting holes (500) located in the top member (220).

In some embodiments, the seat assembly (100) has a swiveling base (300) with a lower base (310) connected to an upper base (320) via a rotational member (330). In some embodiments, the lower base (310) has a plurality of mounting holes (500), and the upper base (320) has a plurality of mounting holes (500). In some embodiments, the lower base (310) is attached to the top member outer surface (224) via fasteners (510) through the plurality of mounting holes (500) located in the lower base (310), and through the plurality of mounting holes (500) located on the top member outer surface (224). In some embodiments, the upper base (320) rotates 360 degrees on a horizontal plane with respect to the lower base (310) via the rotational member (330).

In some embodiments, the rotational member (330) has a roller bearing.

In some embodiments, the seat assembly (100) has a seat (400) with a top sitting surface (410) and a bottom mounting surface (420). In some embodiments, the seat (400) has a plurality of mounting holes (500) located on the bottom mounting surface (420). In some embodiments, the seat (400) is connected to the upper base (320) via fasteners (510) through the plurality of mounting holes (500) located in the upper base (320), and through the plurality of mounting holes (500) located on the bottom mounting surface (420).

In some embodiments, the swiveling seat assembly (100) can be placed on an outer wall (520) of a standard size bathtub. In some embodiments, the lower footing (530) of the outer side member (210) nonslidably interfaces with a ground surface (540). In some embodiments, a top member inner surface (222) nonslidably interfaces with a outer wall top surface (522) of the standard size bathtub. In some embodiments, an inner side member inner surface (232) nonslidably interfaces with an outer wail inner surface (524) of the standard size bathtub, in some embodiments, a user can sit upon the seat assembly (100). In some embodiments, the user sitting on the seat assembly (100) can swivel 360 degrees.

In some embodiments, the lower footing (530) has a non-slip pad (532). In some embodiments, the top member inner surface (222) has a non-slip pad (532). In some embodiments, the outer side member inner surface (212) has a non-slip pad (532). In some embodiments, the inner side member inner surface (232) has a non-slip pad (532).

In some embodiments, the seat (400) has a cushion (412). In some embodiments, the seat (400) is constructed from a water-proof material. In some embodiments, the seat (400) is constructed from a material selected from a group consisting of: metal, plastic, wood, cloth, or resin. In some embodiments, the seat (400) can have a themed logo located on the seat (400) representing a sports team. In some embodiments, the seat (400) can be made from color coordinated materials that may represent a sports team.

In some embodiments, the cushion (412) can be soft. In some embodiments, the cushion (412) can be firm. In some embodiments, the cushion (412) can be constructed from memory foam.

In some embodiments, the frame (200) is constructed from a rigid material. In some embodiments, the frame (200) is constructed from one a material selected from a group consisting of: metal, plastic, wood, or resin. In some embodiments, the frame (200) is collapsible. In some embodiments, the frame (200) has an adjustable height. In some embodiments, the frame (200) has an adjustable width. In some embodiments, the frame (200) can be made from color coordinated materials that may represent a sports team.

In some embodiments, the seat (400) has a rectangle shape. In some embodiments, the seat (400) has a circular shape. In some embodiments, the seat (400) has a seat back. In some embodiments, the seat (400) has a bucket-type seat. In some embodiments, the seat (400) has an accessory holding member for holding razors, shaving cream, and body wash. In some embodiments, the seat (400) has arms that extend from the seat (400).

As used herein, the term "about" refers to plus or minus 10% of the referenced number. For example, an embodiment wherein the seat assembly is about 10 inches in length includes a seat assembly that is between 9 and 11 inches in length.

The disclosures of the following U.S. Patents are incorporated in their entirety by reference herein: U.S. Pat. No. 2,765,475; U.S. Pat. No. 3,289,217; U.S. Pat. No. 4,253,203; U.S. Pat. No. 4,941,218; U.S. Pat. No. 5,373,591; U.S. Pat. No. 6,035,459; U.S. Pat. No. 6,834,400; U.S. Pat. No. D 360,025.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A swiveling seat assembly (100) for safe, and comfortable use on an outer wall (520) of a bathtub, the seat assembly (100) consisting of:

(a) A frame (200) consisting of an outer side member (210), a lower footing (530), an outer side member inner surface (212), a top member (220), a top member inner surface (222), a top member outer surface (224), an inner side member (230), an inner side member inner surface (232), a first inner curve (241), a second inner curve (242), and a plurality of mounting holes (500) disposed in the top member (220), wherein the inner side member (230) is shorter than the outer side member (210);

(b) A swiveling base (300) consisting of a lower base (310) connected to an upper base (320) via a rotational member (330), the lower base (310) consisting of a plurality of mounting holes (500) disposed therein, the upper base (320) consisting of a plurality of mounting holes (500) disposed therein, wherein the lower base (310) is attached to the top member outer surface (224) via fasteners (510) through the plurality of mounting holes (500) disposed in the lower base (310), through the plurality of mounting holes (500) disposed on the top member outer surface (224), wherein the upper base (320) rotates 360 degrees on a horizontal plane with respect to the lower base (310) via the rotational member (330);

(c) A seat (400) consisting of a top sitting surface (410) and a bottom mounting surface (420), the seat (400) consisting of a plurality of mounting holes (500) disposed on the bottom mounting surface (420), the seat (400) is connected to the upper base (320) via fasteners (510) through the plurality of mounting holes (500) disposed in the upper base (320), through the plurality of mounting holes (500) disposed on the bottom mounting surface (420);

wherein a swiveling seat assembly (100) can be placed on an outer wall (520) of a standard size bathtub, wherein the lower footing (530) of the outer side member (210) nonslidably interfaces with a ground surface (540), wherein a top member inner surface (222) nonslidably interfaces with a outer wall top surface (522) of the standard size bathtub, wherein an inner side member inner surface (232) nonslidably interfaces with an outer wall inner surface (524) of the standard size bathtub, wherein a user can sit upon the seat assembly (100), wherein the user sitting on the seat assembly (100) can swivel 360 degrees, wherein the first inner curve (241) connects the outer side member inner surface (212) and the top member inner surface (222), wherein the second inner curve (242) connects the top member inner surface (222) and the inner side member inner surface (232), wherein a non-slip pad (532) begins adjacent to the lower footing (530), and is continuously disposed on and spans the outer side inner surface (212), the first inner curve (241), the top member inner surface (222), the second inner curve (242) and the inner side member surface (232), and terminates at an inner side member bottom edge (231).

* * * * *